United States Patent [19]

Shimizu et al.

[11] Patent Number: 4,701,115

[45] Date of Patent: Oct. 20, 1987

[54] AXIAL SEALING MECHANISM FOR A SCROLL COMPRESSOR

[75] Inventors: Shigemi Shimizu, Sakai; Jiro Iizuka, Takasaki, both of Japan

[73] Assignee: Sanden Corporation, Gunma, Japan

[21] Appl. No.: 814,791

[22] Filed: Dec. 30, 1985

[30] Foreign Application Priority Data

Jan. 28, 1985 [JP] Japan ..... 60-9031[U]

[51] Int. Cl.[4] ..... F04C 18/04; F04C 27/00

[52] U.S. Cl. ..... 418/55; 418/142; 277/204

[58] Field of Search ..... 418/55, 57, 142; 277/204; 29/156.4 R

[56] References Cited

U.S. PATENT DOCUMENTS 4,568,256 2/1986 Blain ..... 418/55

FOREIGN PATENT DOCUMENTS 65261 11/1982 European Pat. Off. ..... 418/55
51-117304 10/1976 Japan .
57-83293 5/1982 Japan .
57-180182 11/1982 Japan .

*Primary Examiner*—John J. Vrablik
*Attorney, Agent, or Firm*—Banner, Birch, McKie & Beckett

[57] ABSTRACT

The present invention relates to a scroll type fluid displacement compressor, and more particularly, to an axial sealing mechanism for sealing the scrolls in an axial direction. A scroll type fluid displacement compressor includes a housing, a pair of scrolls each comprising an end plate and scroll element projecting from one surface of the end plate. Both scroll elements are interfitted at an angular and radial offset to make a plurality of line contacts. A groove is formed on the end surface of each scroll element and a seal element is placed within each groove. The axial thickness of one seal element is equal to or greater than the depth of the groove. The axial thickness of the other seal element is less than the distance between the bottom surface of the other groove and the end plate of the opposing scroll. Thus, one seal element is fixed in the axial direction and the other seal element is movable in the axial direction to effect a proper axial sealing of the scrolls while making it possible to more easily manufacture and assemble the scroll compressor.

1 Claim, 3 Drawing Figures

AXIAL SEALING MECHANISM FOR A SCROLL COMPRESSOR

TECHNICAL FIELD

The present invention is directed to a scroll type fluid displacement compressor, and more particularly, to the axial sealing mechanism between the scrolls of such a compressor.

BACKGROUND OF THE INVENTION

Scroll type fluid displacement compressors are well known in the prior art. For example, U.S. Pat. No. 801,182 issued to Creux discloses such a compressor which includes two scrolls, each having an end plate and a spiral wrap or scroll element. The scrolls are positioned relative to each other so that the scroll elements interfit at an angular and radial offset to form compression spaces, namely, fluid pockets sealed off by the end plates and by the side walls of the scroll elements. By driving one of the scrolls in an orbital motion without rotation of the scrolls, the fluid pockets are moved toward the center of the scroll elements thereby compressing the fluid pockets.

An axial seal mechanism generally is employed to seal off the fluid pockets in the axial direction. Such an axial seal mechanism usually include seal elements disposed on the axial ends of the scroll elements of both scrolls to seal off the gap between the axial end surface of each scroll element and the end plate adjacent the axial end surface. The seal elements are disposed in grooves formed along the axial end surfaces of the scroll elements. Two types of seal mechanisms have been used in scroll compressors.

The first type of seal mechanism is shown in Public Disclosure of Japanese patent application No. 51-117304 and Public Disclosure of Japanese Utility Model No. 57-83293. In these applications the seal elements of both scrolls move axially within their respective grooves. These seal elements are urged against the end plates by a spring disposed in the bottom of the groove or back pressure from the compressed fluid between the scrolls.

The second type of seal mechanism is shown in Public Disclosure of Japanese Utility Model No 57-180182. Each of the seal elements of this seal mechanism are first placed between the bottom of the groove and the end plate, and then deformed by compression during assembly to fill the gap between the scroll element and the end plate. Both seal elements extend between the bottom of the grooves and the opposing end plates.

In both the first and second types of seal mechanisms, the axial end surfaces of the scroll elements and the opposing end plates must not contact each other. It is important to maintain an axial gap between them to allow for heat expansion and prevent excessive wear to the scrolls.

In the first type of seal mechanism, since both seal elements can move a limited distance in the axial direction, it is difficult to set the elative axial location of both scrolls. When the axial end surface of the scroll element of one scroll is placed directly against the end plate of the other scroll without a gap between them, the seal elements cannot move axially, and the seal elements cannot function. Accordingly, an axial gap between the scrolls is necessary, but this axial gap makes it difficult to assemble the compressor. Also, since the scrolls must maintain a predetermined axial position during operation, additional mechanisms are required which complicate the construction of the compressor.

Also, in the second type of seal mechanism, since both seal elements are disposed between the bottom of the groove of the scroll element and the opposing end plate, high precision is required in the manufacture of the seal elements and each part of the scrolls. Hence, it is difficult to produce a scroll compressor.

SUMMARY OF THE INVENTION

It is one object of the present invention to provide a scroll type fluid displacement compressor which can be easily assembled.

It is another of the present invention to provide a scroll type fluid displacement compressor which is simple in construction.

It is a further object of the present invention to provide a scroll type fluid displacement compressor which can be easily produced.

These and other objects of the present invention are achieved by providing a scroll type fluid displacement compressor which includes a pair of scrolls having first and second end plates with scroll elements (spiral wraps) extending therefrom. Each scroll element has a groove formed on the end surface opposite the end plate. Seal elements are located in each groove. The axial thickness of one seal element is equal to or greater than the depth of the groove. The axial thickness of the other seal element is less than the depth of the other groove or, in other words, less than the distance between the bottom of the other groove and the end plate of the other scroll. Thus, one seal is fixed in the axial direction and the other seal element is movable to effect a proper axial sealing of the scrolls while making it possible to more easily manufacture and assemble the scroll compressor.

Further objects, features and other aspects of the present invention will be understood from the following detailed description of the preferred embodiment with reference to the attached drawings.

DETAILED DESCRIPTION OF THE PREFERRED EMBODIMENT

Figure 1:
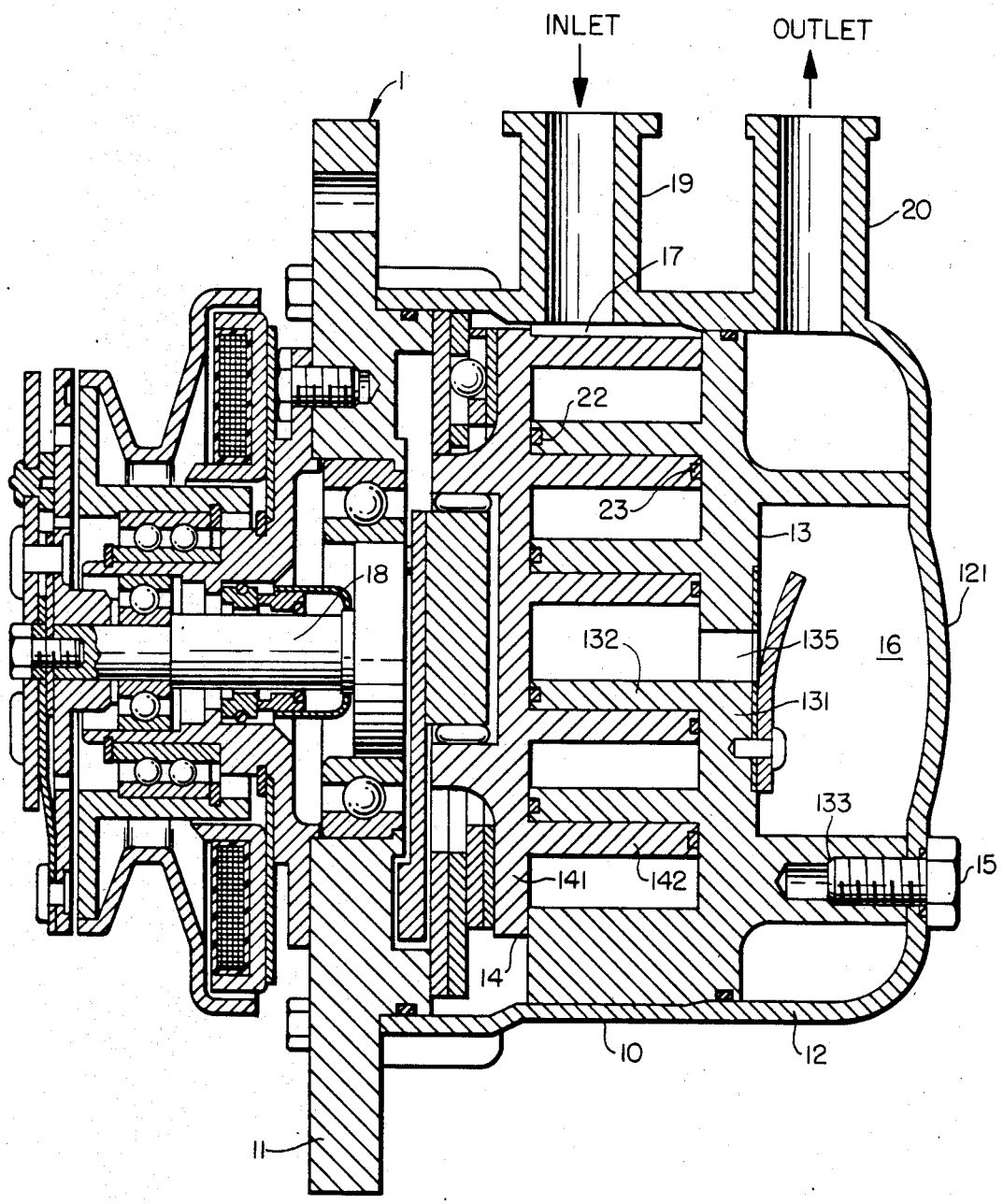
FIG. 1 is a vertical cross-sectional view of a scroll type fluid displacement compressor in accordance with the present invention.

Referring to FIG. 1, scroll type fluid compressor 1 is shown having compressor housing 10 which comprises front end plate 11 and cup shaped casing 12. Fixed scroll 13 and orbiting scroll 14 are placed in housing 10. Fixed scroll 13 includes end plate 131, scroll element or spiral wrap 132 which is formed on one surface of end plate 131 and projecting portion 133 which is formed on the other surface of end plate 131. Projecting portion 133 is fixed on the inner wall of a bottom portion 121 of cup shaped casing 12 by bolt 15 which penetrates through cup shaped casing 12. End plate 131 of fixed scroll 13, which is secured to cup shaped casing 12, divides the inner space of cup shaped casing 12 into discharge chamber 16 and suction chamber 17 due to the sealing between the outer surface of end plate 131 and the inner wall surface of cup shaped casing 12.

Orbiting scroll 14 includes end plate 141 and scroll element of spiral wrap 142 which is formed on one surface of end plate 141. Scroll element 142 interfits with scroll element 132 of fixed scroll 13 at an angular and radial offset to form a plurality of line contacts to seal off fluid pockets in a manner known in the art. Orbiting scroll 14 is coupled to drive shaft 18 which is rotatably supporting by front end plate 11 for driving orbiting scroll 14 in an orbital motion. Since the drive mechanism which drives orbiting scroll 14 without rotation on its axis is known in the art, the detailed explanation of this drive mechanism is omitted.

When orbiting scroll 14 is driven in an orbital motion, the fluid, which flows from suction port 19 on cup shaped casing 12 to suction chamber 17 in housing 10, is taken into the fluid pockets formed between scroll elements 132 and 142. The fluid is gradually compressed and moved toward the center of the scroll elements. Compressed fluid at the center of the scroll elements moves to discharge chamber 16 through discharge hole 135 formed in end plate 131 of fixed scroll 13. The compressed fluid is discharged to the outside of housing 10 through discharge port 20.

Figure 2:
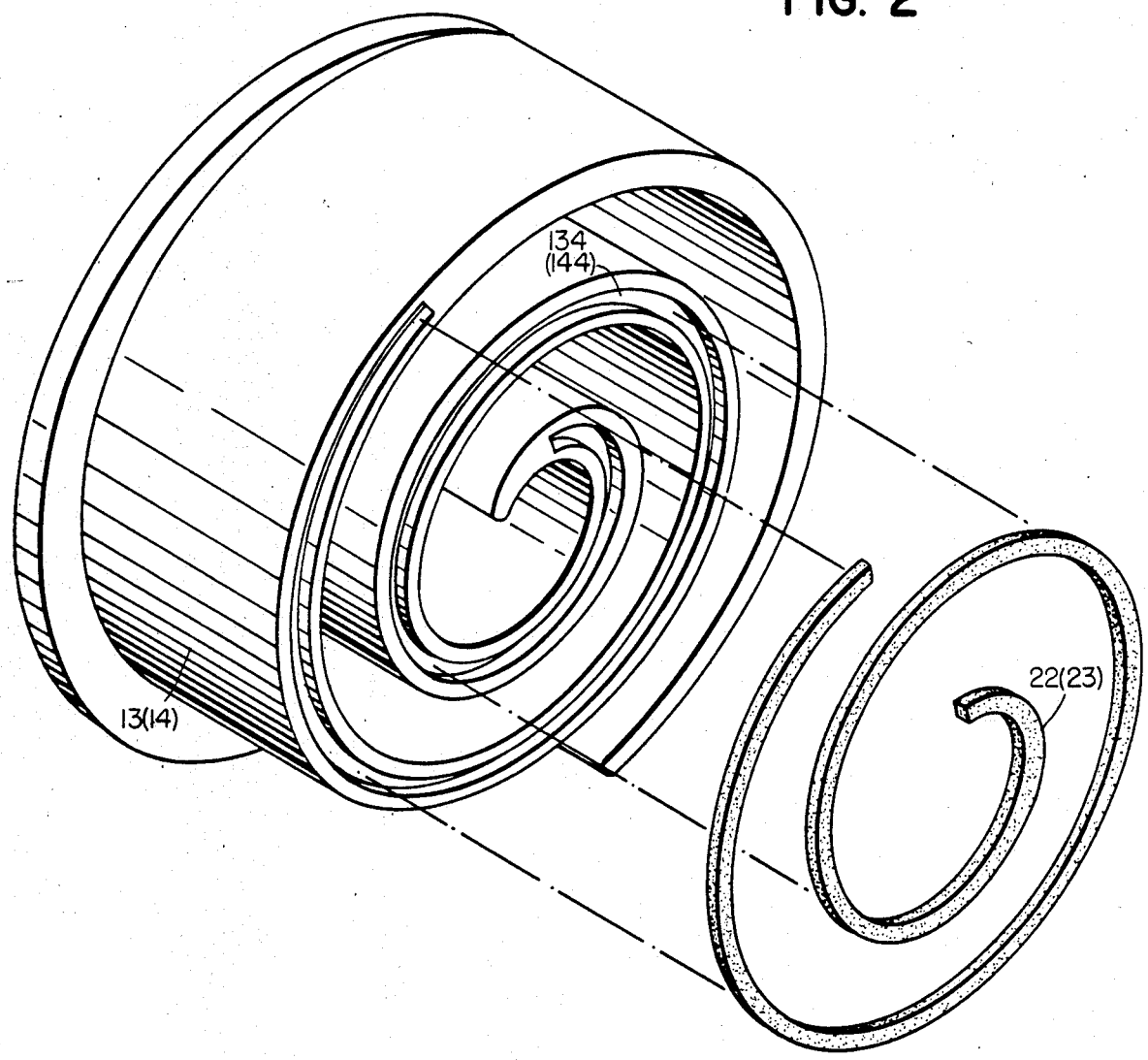
FIG. 2 is a perspective view illustrating the structure of one of the scrolls shown in FIG. 1 and its seal element.

Referring to FIG. 2, grooves 134 and 144 are formed on the axial end surfaces of scroll elements 132 and 142, respectively. Scroll elements 132 and 142 project from end plates 131 and 141 of fixed scroll 13 and orbiting scroll 14, respectively. Each groove extends along the spiral of the scroll element. Seal elements 22 and 23 are placed in grooves 134 and 144, respectively.

Figure 3:
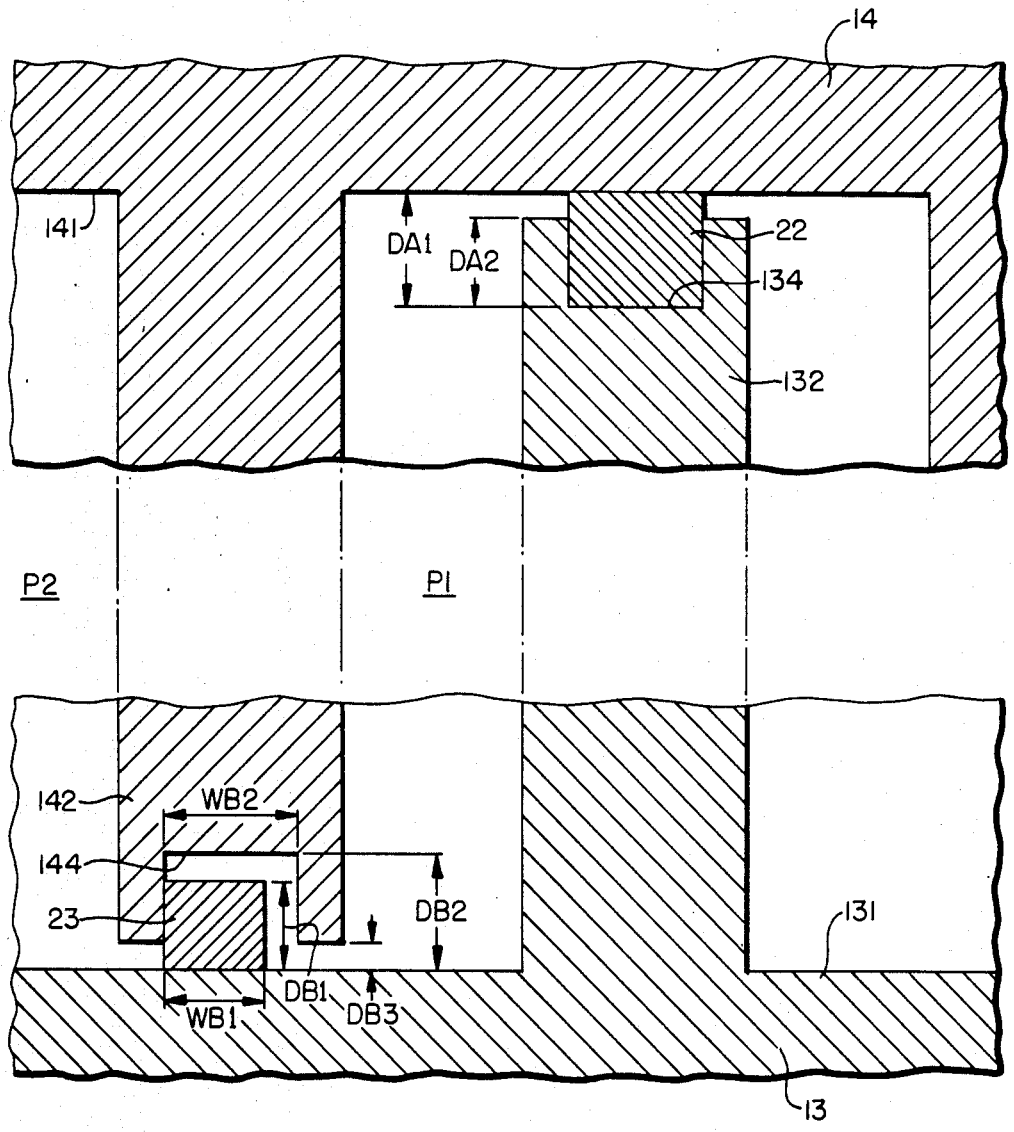
FIG. 3 is a cross-sectional view illustrating the size of the grooves of the scrolls in FIG. 1 and their seal elements.

Referring to FIG. 3, axial thickness DA1 of seal element 22, which is placed in groove 134 formed on the axial end surface of scroll element 132 of fixed scroll 13, is greater than depth DA2 of groove 134. Therefore, when orbiting scroll 14 and fixed scroll 13 are placed in their interfitting positions, end plate 141 of orbiting scroll 14 abuts seal element 22. Seal element 22 is disposed between the bottom surface of groove 134 of scroll element 132 of fixed scroll 13 and end plate 141 of orbiting scroll 14. As a result, the relative axial position of fixed scroll 13 and orbiting scroll 14 is determined.

Width WB1 of the other seal element 23 is less than width WB2 of groove 144 formed on the axial end surface of scroll element 142 of scroll 14. Also, axial thickness DB1 of seal element 23 is less than distance DB2 between the bottom surface of groove 144 and end plate 131 of fixed scroll 13 and greater than distance DB3 between end plate 131 of fixed scroll 13 and the axial end surface of scroll element 142 of orbiting scroll 14. Therefore, seal element 23 is free to move in an axial direction by a predetermined amount within groove 144.

When the compressor is assembled, since orbiting scroll 14 is urged against fixed scroll 13, seal element 22 always abuts end plate 141 of orbiting scroll 14. Therefore, scroll element 132 of fixed scroll 13 and end plate 141 of orbiting scroll 14 are sealed by seal element 22.

Seal element 23 is urged against the side wall of groove 144 by the difference in pressure between fluid pockets P1 and P2 produced during operation of the compressor. Also, seal element 23 is urged against end plate 131 of fixed scroll 13 by back pressure. Therefore, end plate 131 of fixed scroll 13 and scroll element 142 of orbiting scroll 14 are sealed by seal element 23.

In the above scroll compressor, one seal element 22 in fixed scroll 13 is fixed and the other seal element 23 in orbiting scroll 14 is movable. The opposite construction also can be used. Namely, seal element 22 can be inserted into groove 144 of scroll element 142 of orbiting scroll 14 and seal element 23 can be inserted into groove 134 of scroll element 132 of fixed scroll 13.

This invention has been described in detail in connection with a preferred embodiment, but this embodiment is an example only and the invention is not restricted thereto. It will be easily understood by those skilled in the art that other variations and modifications can be easily made within the scope of the appended claims.

We claim:

1. In a scroll type fluid displacement compressor including a housing, a pair of scrolls, one of said scrolls fixedly disposed relative to said housing and having an end plate from which a first scroll element extends into the interior of said housing and the other scroll movably disposed for non-rotative orbital motion within the interior of said housing and having an end plate from which a second scroll element extends, said first and second scroll elements interfitting at an angular and radial offset to make a plurality of line contacts to define at least one pair of sealed off fluid pockets and drive means operatively connected to said other scroll to effect the orbital motion of said other scroll and said line contacts, the improvement comprising:

a groove formed on the axial end surface opposite said end plate of each of said first and second scroll elements;

a first seal element disposed in a first groove, said first seal element having an axial thickness equal to or greater than the depth of said first groove and a width substantially equal to the width of said first groove; and a second seal element disposed in a second groove, said second seal element having an axial thickness less than the distance between the bottom surface of said second groove and the end plate of the opposing scroll wherein the width of the second seal element is less than the width of said second groove so that said second seal element is movable in an axial direction within said second groove in response to the fluid pressure of the fluid pockets within said scroll.

* * * * *